US005522768A

United States Patent [19]

Brodt et al.

[11] Patent Number: 5,522,768

[45] Date of Patent: Jun. 4, 1996

[54] ACOUSTIC ATTENUATING CURB

[75] Inventors: Clarence R. Brodt, La Crosse; Gregory L. Meeuwsen, West Salem; Richard T. Weisbecker, La Crosse, all of Wis.

[73] Assignee: American Standard Inc., Piscataway, N.J.

[21] Appl. No.: 305,223

[22] Filed: Sep. 13, 1994

[51] Int. Cl.[6] ..... F24F 13/02

[52] U.S. Cl. ..... 454/234; 62/296; 62/DIG. 16; 454/233; 454/236; 454/906

[58] Field of Search ..... 62/259.1, 29.6, 62/DIG. 16; 454/228, 230, 232, 233, 234, 235, 236, 906

[56] References Cited

U.S. PATENT DOCUMENTS

| | | | |
|---|---|---|---|
| 3,085,647 | 4/1963 | Jenn et al. | 181/56 |
| 3,702,211 | 11/1972 | Young et al. | 312/257 |
| 4,016,729 | 4/1977 | Cherry | 62/259 |
| 4,018,266 | 4/1977 | Kay | 165/12 |
| 4,118,083 | 10/1978 | Lackey et al. | 62/DIG. 16 X |
| 4,315,415 | 2/1982 | Wilson | 62/263 |
| 4,403,481 | 9/1983 | Yoho, Sr. | 62/259.1 |
| 4,501,193 | 2/1985 | Trigourea . | |
| 4,641,502 | 2/1987 | Aldrich et al. | 62/DIG. 16 X |
| 4,759,196 | 7/1988 | Davis | 454/236 X |
| 5,324,229 | 6/1994 | Weisbecker | 454/233 |

OTHER PUBLICATIONS

"Roof Curb Rooftop Single Zone Air Conditioner", Service Literature File Information, Trane Air Conditioning, Feb., 1977.

"Roof Curb Rooftop Single Zone Air Conditioners with Chilled Water Coils", Service Literature File Information, Trane Air Conditioning, Jan., 1977.

*Primary Examiner*—Harold Joyce

*Attorney, Agent, or Firm*—William J. Beres; William O'Driscoll; Peter D. Ferguson

[57] ABSTRACT

A noise reduction curb for use as an interface with a rooftop air conditioning unit by forming a base upon which the air conditioning unit rests and is mounted on a roof of a building. A noise reduction supply air duct is oriented in the longitudinal dimension of the air conditioning unit and has a supply air inlet fluidly coupled to the supply air source and a supply air outlet fluidly coupled directly to the supply ducts in the building. The supply air inlet is longitudinally displaced from the supply air outlet and is separated therefrom by a flow turbulence reducing substantially straight duct section. A noise reduction return air duct is oriented in the lateral dimension of the air conditioning unit and has a return air inlet fluidly coupled directly to the return air ducts in the building and a return air outlet fluidly coupled to the air conditioning unit. The return air inlet is laterally displaced from the return air outlet.

20 Claims, 5 Drawing Sheets

Performance of Quiet Curb for Supply Path

Performance of Quiet Curb for Return Path

ACOUSTIC ATTENUATING CURB

DESCRIPTION

1. Technical Field

The present invention relates to a curb for use with a rooftop mounted air conditioning unit. More particularly, the curb of the present invention has acoustic attenuation properties.

2. Background of the Invention

Rooftop air conditioners typically circulate conditioned air through zones of the building in which the air conditioning unit is mounted. The air conditioning unit has a supply air side and return air side. In the supply air side, fans generate a flow of conditioned air from the supply air side of the air conditioning unit to supply ducts mounted in the building. The conditioned air may be either heated or cooled as desired.

The supply ducts are routed through the building to discharge the supply air into the rooms that comprise the heating and cooling zone. Such routing typically involves a number of straight line duct sections, duct elbows, and T joints in the ducts in order to deliver the supply area to the zone as desired.

The corresponding set of return air ducts is utilized to extract air from the heating/cooling zone and return it to the air conditioning unit mounted on the roof. The return air ducts are constructed similar to the supply air ducts in that the return air ducts also include straight sections, elbows and T-joints. The return air ducts are connected to the return air side of the air conditioning unit. Generally, a plurality of fans are mounted in the air conditioning unit to generate the flow from the heating/cooling zone through the return air duct to the return air side of the air conditioning unit.

A problem with such installations has been noise in both the supply ducts and the return ducts. Such noise is transmitted through the ducts to the heating/cooling zone. The noise in the ducts is then transmitted into the rooms of the heating/cooling zone, where it can be objectionable to occupants. In the supply ducts, the principal sources of such noise are the supply fans in the air conditioning unit that force the supply air from the supply air side of the air conditioning unit into supply duct and turbulent flow in the supply duct. The turbulent flow in the supply ducts regenerates noise especially as the flow passes through the elbows of the supply ducts. In the return ducts, the principal sources of such noise are the exhaust fans in the air conditioning unit that exhaust the return air to the atmosphere under certain circumstances. The noise is known to be more acute when there is a direct line of sight from the source of the noise to the ducts in the building.

Noise is unwanted or objectionable sound. A number of standards have been designed in order to define the limits for specific types of noise makers and to specify how the sound is to be measured. One such commonly used standard is the Noise Criteria (NC) curves. The NC curves are used to rate the noisiness of an indoor space. The NC curves consist of established octave band spectra. The octave band center frequencies are 63 Hertz (Hz), 125 Hz, 250 Hz, 500 Hz, 1000 Hz, 2000 Hz, 4000 Hz, and 8000 Hz.

The projected or measured NC level within an occupied space is determined by the highest NC level corresponding to the sound pressure level in any octave band. A sound pressure level of 57 decibels (dB) in a 63 Hz band, for example, corresponds to NC 30, whereas 57 dB in the 125 Hz band corresponds to NC 40.

Typical room design NC criteria are as indicated in Table 1.

| | Low | Average | High |
|---|---|---|---|
| Apartment Houses | 30 | 35 | 40 |
| Hotel Rooms, Suites | 30 | 35 | 40 |
| Offices, General Open Offices | 35 | 40 | 50 |
| Public Buildings Banking Areas | 35 | 40 | 45 |
| Restaurants, Nightclubs | 35 | 45 | 50 |
| Manufacturing, light assembly | 45 | 60 | 70 |

When designing an air conditioning system for a building, a number of factors are considered in order to make the air conditioning system meet the desired NC. The first such factor is the room and terminal effect. This factor accounts for the size and acoustic characteristics of the space as well as the number and location of the duct terminals in the space. A second factor is allowance for end reflection. End reflection accounts for the fact that some low frequency noise is reflected back into the duct. Other factors include attenuation caused by the duct work, the elbows in the duct work, and the T shaped branches to the various duct terminals in the rooms to be air conditioned. When the foregoing factors are considered and a resultant expected noise level still exceeds the desired NC, a duct silencer is typically inserted into the duct work that is installed in the building. Duct silencers have some disadvantages, including a relatively high cost and the fact that the use of the silencer results in a pressure drop in the duct. Such pressure drop results in higher operating costs for the air conditioning system. It is significant to note that duct silencer efforts have concentrated on silencing the ducts that are installed in the building.

In the past, curbs have been used in conjunction with rooftop air conditioning units to provide a variety of functions not related to sound attenuation. An example of such usage is U.S. Pat. No. 4,501,193 which uses a curb system to mount multiple air conditioning units and to connect the multiple air conditioning units to a single common supply duct and return duct installed in the building. The structure of the supply air duct in the curb and the return air ducts in the curb are generally L shaped with the supply air ducts overlying the associated return air duct for each individual air conditioning unit.

U.S. Pat. No. 4,403,481 utilizes the curb of the air conditioning unit to form a plenum. A large supply air, as defined within the curb with a relatively small return air plenum occupying a space in the corner of the curb, a plurality of supply air ducts depends from the air conditioning unit into the supply air portion of the plenum. The supply air ducts in the building are not connected physically to the aforementioned supply air duct depending from the air conditioning unit, but are merely connected to the bottom of the plenum.

U.S. Pat. No. 4,016,729 utilizes a curb as a plenum to feed supply air to a supply air duct in the building that is concentric with the return air duct in the building. The return air duct is formed in the center of the supply air duct. It should be noted that the supply air plenum is connected to only a portion of the supply air duct and the plenum is connected in direct line of sight between the air conditioning unit and that portion of the supply air duct.

The aforementioned patents have neither the structure of the present invention nor suggest the structure of the present invention.

It would be a decided advantage in the industry to be able to provide for a substantial reduction in the NC level in both the supply air and return air ducts. It is preferably to accomplish such reduction without compromising the ease of installation of the air conditioning unit on the building and without having to construct complex noise reduction structure within the ducts. Additionally, it is desirable to confine the noise reduction structure to the area immediately beneath the air conditioning unit in order to minimize the amount of space that the air conditioning unit and its associated curb occupy on the roof.

SUMMARY OF THE INVENTION

The present invention provides a curb comprising: four exterior walls joined in a box like shape; a bottom for the box including a return air aperture and a supply air aperture; and a dividing wall in the box separating the supply and return air apertures and forming a return air duct and a supply air duct; wherein the supply air duct is arranged perpendicularly to the return air duct.

The present invention also provides the desired noise reduction by means of specifically designing the curb as noise reduction ducts to convey the supply air from the air conditioning unit to the supply air duct and to convey the return air from the return air duct to the air conditioning unit. The noise reduction ducts compel the air flow to make at least two right hand turns between the air conditioning unit and the duct work in the building, thereby eliminating any line of sight noise transmission. Additionally, the noise reduction duct work for the supply air includes a relatively long straight flow section having substantially the same cross sectional area as the area of the supply air outlet in the air conditioning unit. This elongated straight flow section substantially reduces the turbulence of the supply air prior to the supply air entering the supply air duct in the building. The noise reduction duct work is confined to the area immediately beneath the air conditioning unit in order to minimize the air conditioning unit footprint on the rooftop. The return air noise reduction duct work and the supply air noise reduction duct work define two ducts oriented in a T-shape and lying beneath the air conditioning unit.

The invention comprises a sound attenuating curb for use with an air conditioning unit, the air conditioning unit supplying conditioned air to a building via a supply duct installed in the building and receiving return air via a return duct installed in the building. The curb includes structure defining a supply air conveying duct fluidly coupling the air conditioning unit to the supply duct. The supply air conveying duct has all inlet defined at a first end of an elongated section and an outlet defined at a second end of the elongated section. The supply air conveying duct causes the conditioned air to define a path of travel having a generally right angle turn at the inlet, straight flow through the elongated section and a generally right angle turn at the outlet. The curb also includes structure defining a return air conveying duct fluidly coupling the return duct to the air conditioning unit. The return air conveying duct has an inlet defined at a first end thereof and an outlet defined at a second end thereof, the inlet being offset with respect to the outlet such that the return air is caused to define a flow path of travel having a generally right angle turn at the inlet and a generally right angle turn at the outlet.

DETAILED DESCRIPTION OF THE DRAWINGS

Figure 6:
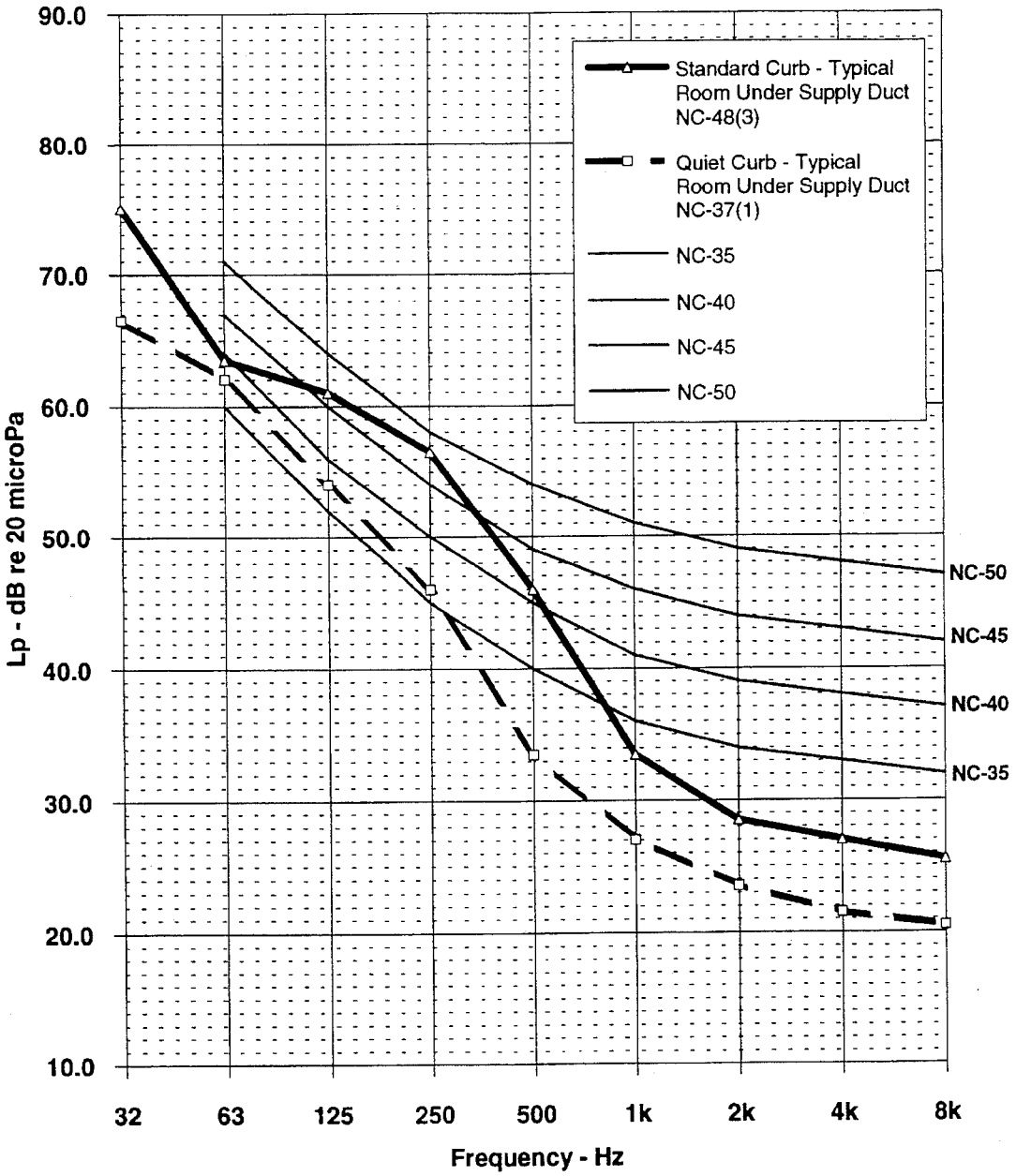
Figure 7:
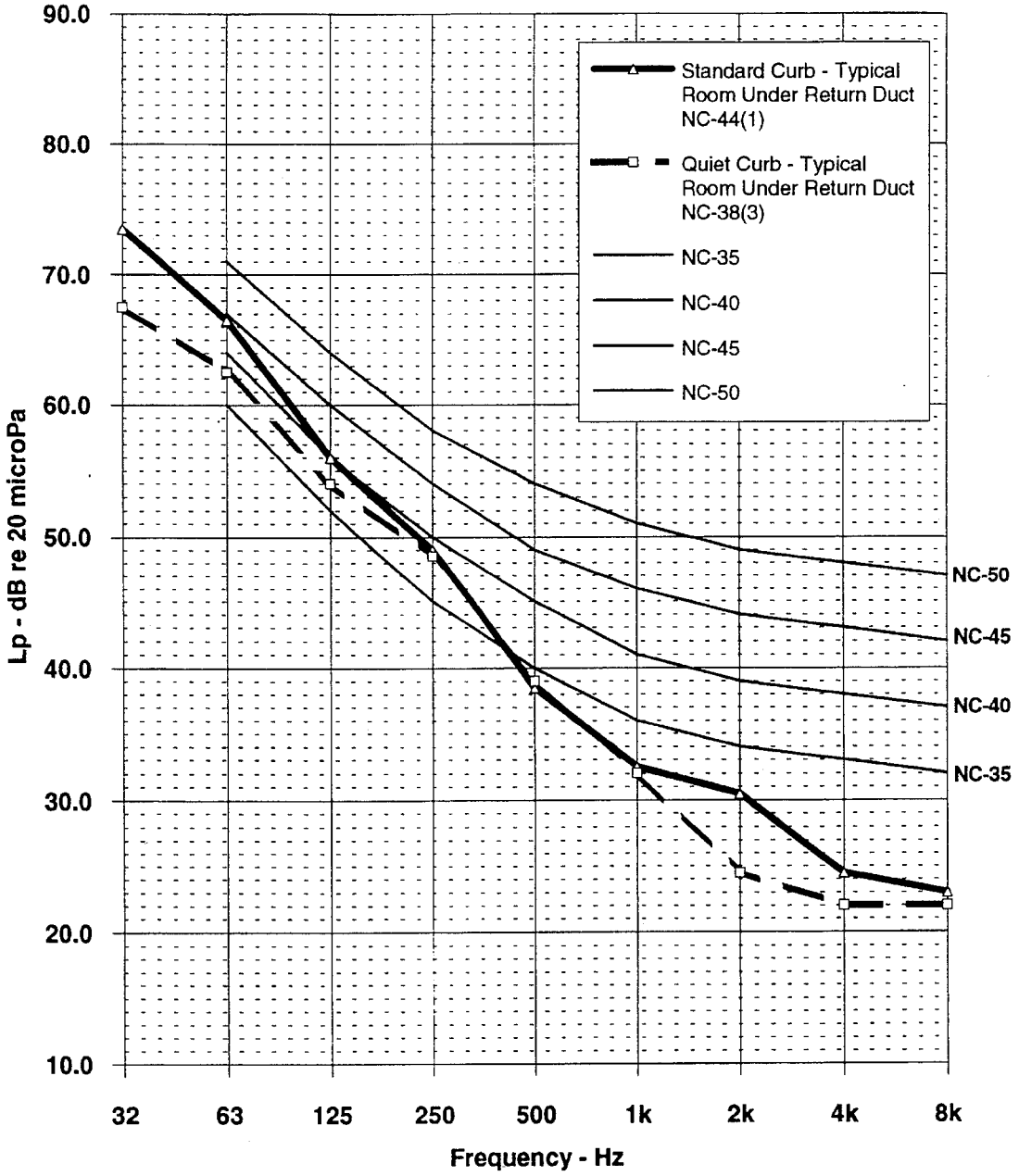

FIG. 6 is a graph of sound pressure level in a typical room below the supply duct comparing a prior art duct to the sound power level in the supply duct of the present invention; and FIG. 7 is a graph of the sound pressure level in a typical room below the return air duct when using a prior art duct as compared to the sound pressure level in the return duct when using a curb made according to the present invention.

Figure 8:
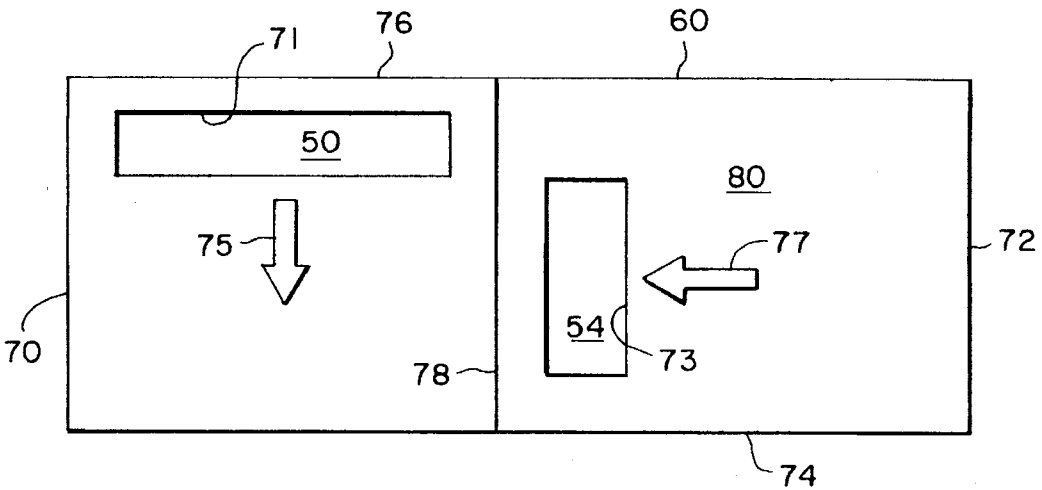

FIG. 8 is a top elevational view of the curb of the present invention.

DETAILED DESCRIPTION OF THE DRAWINGS

Figure 1:
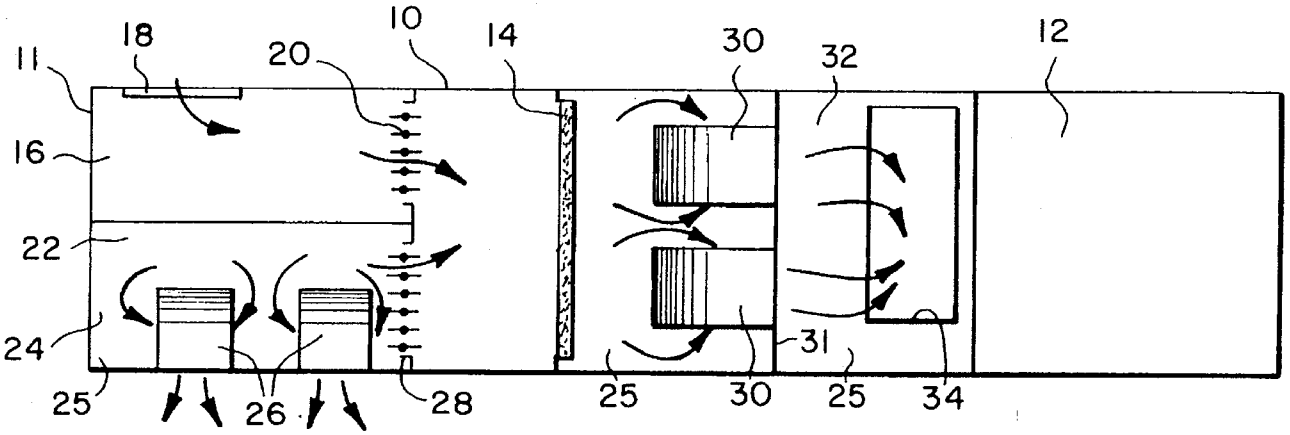
FIG. 1 (PRIOR ART)
FIG. 1 is a top elevational view of an air conditioning unit with a prior art curb.
Figure 2:
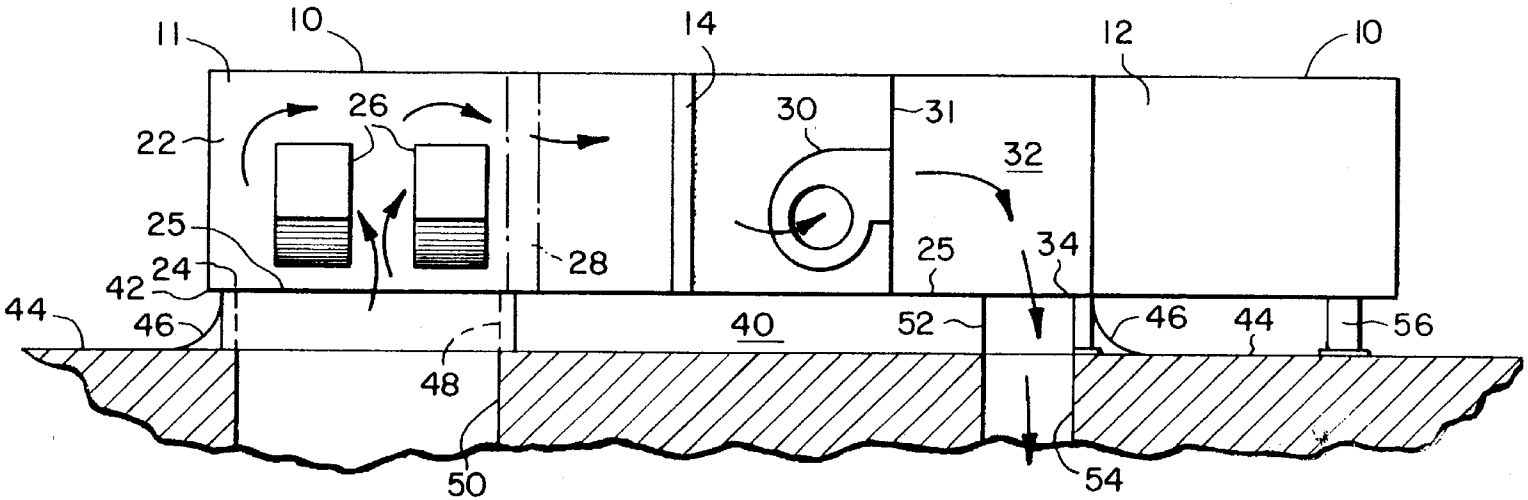
FIG. 2 (PRIOR ART)
FIG. 2 is a side elevational view of an air conditioning unit with a prior art curb.

In this description, similar numerals are used to designate similar components appearing in the various figures. FIGS. 1 and 2 depict a prior art curb utilized with a current rooftop type air conditioning unit shown generally at 10. Such a rooftop unit is shown in U.S. Pat. No. 5,324,229 to Weisbecker, which is commonly assigned with the present invention and incorporated herein by reference. The air conditioning unit includes a compressor section 12. Compressor section 12 compresses a refrigerant and provides it to a coil 14 via piping (not shown) that is routed along the floor of air conditioning unit 10.

The refrigerant expands in coil 14 thereby cooling air passing therethrough. A second coil may be used in conjunction with coil 14 which a heated fluid is circulated for use in heating air flowing therethrough. In this manner, air conditioning unit 10 may be used to either heat or cool the conditioned air and accordingly the building zone surfaced by air conditioning unit 10.

Air is provided to coil 14 from two different sources. The first such source is outside air passing through outside air plenum 16. The outside air is drawn in through outside air inlet 18, passes through the outside air plenum 16 via louvers 20. Insert in applications, the louvers 20 are adjustable in order to control the amount of outside air entering air conditioning unit 10.

The return air plenum 22 is located adjacent to outside air plenum 16 and is fluidly separated therefrom. Two exhaust fans 26 are mounted on the sidewall of return air inlet 24 and are utilized to exhaust return air under certain conditions as desired.

A large return air inlet 24 is defined in the bottom portion of return air plenum 22. The return air entering return air plenum 22 via return air inlet 24 may be drawn through louvers 28 or exhausted from return air plenum 22 via exhaust fan 26 as desired. The positioning of louvers 20 and 28 is typically coordinated in order to provide the desired mix of outside air and return air passing through coil 14.

Centrifugal supply air fans 30 are mounted on the high pressure wall 31. High pressure wall 31 separates the relatively high pressure plenum 32 from the low pressure portion of air conditioning unit 10 that is located approximate the intakes to supply air fans 30. A generally rectangular shape supply air outlet 34 is defined in the bottom portion of the supply air plenum 32.

The prior art curb 40 is depicted in FIG. 2. In general, a curb is usually installed on the roof in the early stages of construction of a building. The curb is made water tight with the roof. At a later time, when the construction of the building is nearly complete, an air conditioning unit 10 is lowered on top of the curb. Accordingly, curb 40 has a wooden nailer 42 at the upper perimeter of curb 40. Flashing 46 is attached to nailer 42 and cemented to roof 44 to create a water tight bond therewith. A connector 48 is interposed between the return air duct in the building and the return air inlet 24 of return air plenum 22. A second connector 52 is interposed between the building supply air duct 54 and the supply air outlet 34 of the supply air plenum 32. A leg support 56 mounted on the roof 44 is utilized to support compressor section 12.

It should be noted that with respect to the generation of noise in the return air duct and the supply air duct of the building in prior ducts, there is a direct line of sight for the introduction of noise from the exhaust fans 26 and supply air fans 30 into the return air duct 50 and supply air duct 54 respectively. Additionally, the supply air fans 30 generate a substantial amount of turbulence in the supply air as the air ms drawn through the supply air fans 30. The supply air flows in such turbulent condition through supply air plenum 32 and directly into the supply air duct 54.

Figure 3:
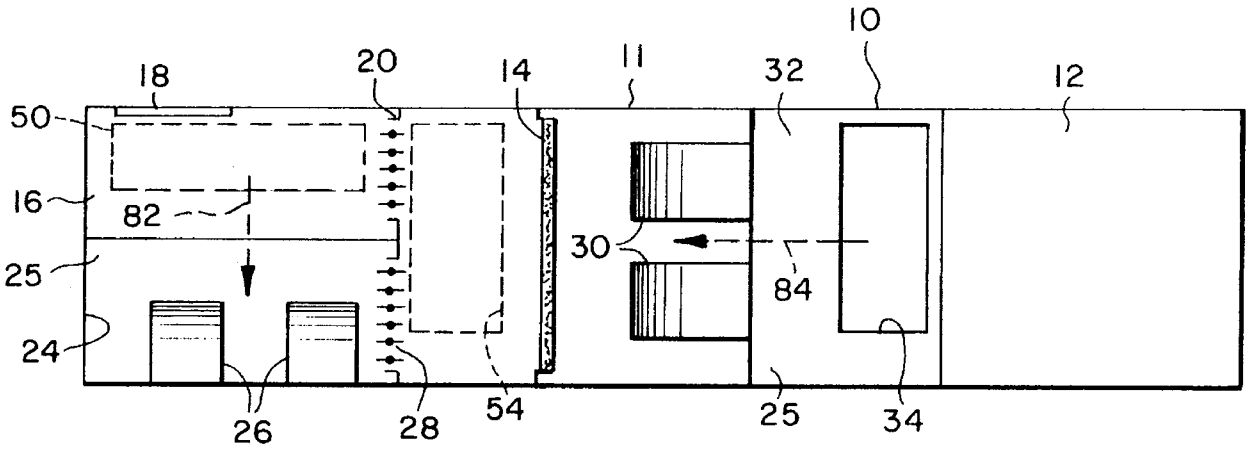
FIG. 3 is a top elevational view of an air conditioning unit having a curb made according to the present invention.
Figure 4:
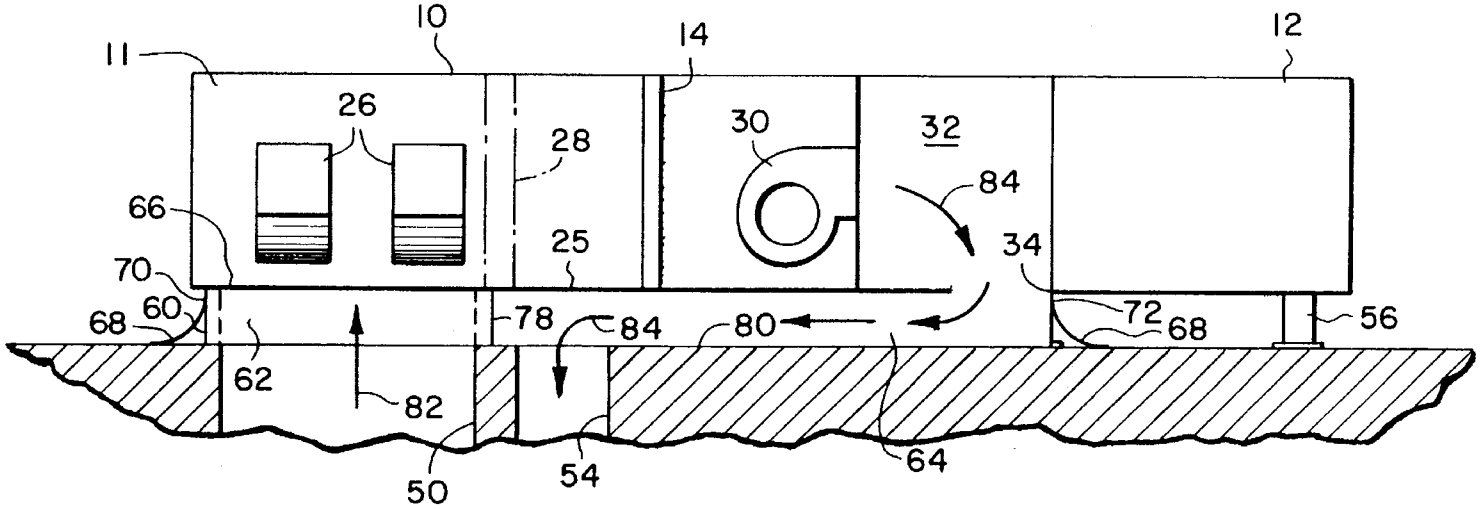
FIG. 4 is a side elevational view of an air conditioning unit having a curb made according to the present invention.
Figure 5:
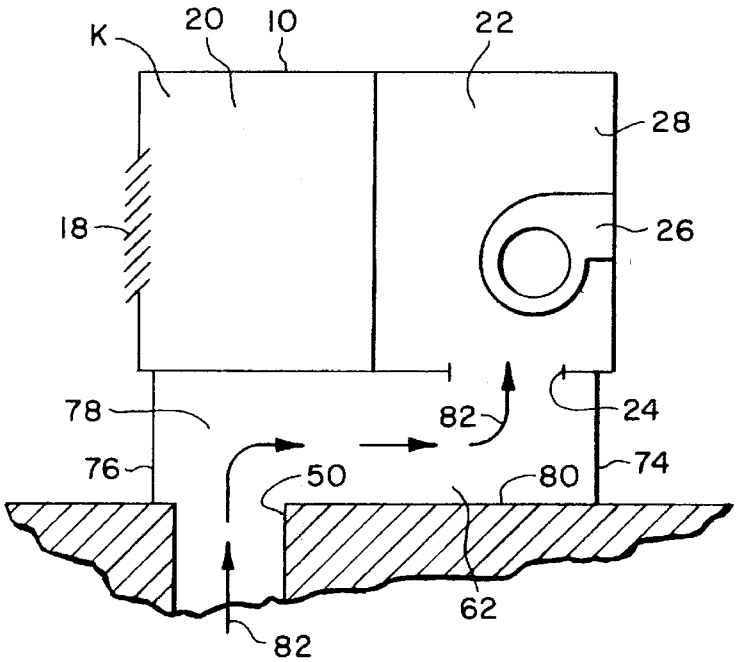
FIG. 5 is an end elevational view of an air conditioning unit having a curb made according to the present invention.

FIGS. 3–5 depict the previously described air conditioning unit 10 mounted on the noise reduction curb 60 made according to the present invention. Curb 60 includes a return air noise reduction duct 62 and a supply air noise reduction duct 64. Curb 60 is designed to be integrated with the roof of a flat topped building in much the same way as conventional curbs. Accordingly, the upper margin 66 of noise reduction curb 60 include a wooden nailer 42 in order to suitably affix flashing 68 thereto. The wooden nailer 42 is typically 2×4 board that is positioned on its side with the underside supported by the curb 60 structure and the upperside exposed to facilitate the nailing of flashing material thereto to create a watertight seal with the roof structure.

A generally horizontal lip is formed at the upper margin of the curb 60. The upper lip is generally of the same dimensions as the underside of the air conditioning unit 10 and is designed to mate therewith. In practice, the air conditioning unit 10 is typically positioned on top of the curb 60 sometime after the curb 60 has been tied into the roof of the building. The air conditioning unit 10 is positioned on top of the curb 60 by a crane or, in some instances, by a helicopter. The air conditioning unit 10 may not be bolted to the curb, but may simply rest on top of the lip of the curb 60. Since the air conditioning unit is so positioned in a fully charged condition, all that is need to make the air conditioning unit 10 operational is to connect the electrical power, the curb 60 already having been connected to the air conditioning ducting in the building.

Referring now also to FIG. 8, the return air noise reduction duct 62 and supply air noise reduction duct 64 are formed by end panels 70, 72 as depicted in FIG. 4, side panels 74, 76 as depicted in FIG. 5, and bottom panel 80. The top of return air noise reduction duct 62 and supply air noise reduction duct 64 is formed by the bottom member 25 of air conditioning unit 10. A transverse panel 78 fluidly separates the return air noise reduction duct 62 from supply air noise reduction duct 64. The curb 60 also includes a return air aperture 71 aligned with the return air duct 50, and a supply air aperture 73 aligned with the supply air duct 54. Arrow 75 indicates the direction of return air flow within the curb 60, while arrow 77 indicates the direction of supply air flow within the curb 60. The supply air flow 77 in supply air noise reduction duct 64 is crossed by the transverse return air flow 75 in return air noise reduction duct 62, forming the characteristic "T" shape of the present invention. The use of this "T" shape reduces the length and area ('footprint') of the curb 60 on the roof since the supply and return air flows are perpendicular rather than in line.

The end panels 70, 72 and the side panels 74, 76 form the exterior structure of the curb 60 as well as defining portions of the return air noise reduction duct 62 and supply air noise reduction duct 64. The end panels 70, 72 and the side panels 74, 76 are typically formed of a material that exhibits good resistance to the effects of being constantly exposed to the elements. Accordingly, the end panels 70, 72 and the side panels 74, 76 may be formed of galvanized sheeting or the like. The sheeting is typically with a suitable pattern of creases and ribs stamped therein to minimize the "oil can" effects that can occur with pressure differentials on the two sides large flat sections of such sheeting.

Weight bearing standards (not shown) are formed integral to the curb 60 at the corners thereof and at suitable intervals along the end panels 70, 72 and the side panels 74, 76 thereof. Typically, such standards are comprised of rectangular shaped tubes. The standards are positioned to transfer the weight of the air conditioning unit 10 to the structural members of the roof of the building. Accordingly, the standards are typically positioned directly above the structural members of the roof of the building, such as the trusses thereof. The standards support the upwardly directed lip of the curb 60 on which the air conditioning unit 10 is positioned.

Preferably, the interior sides of the end panels 70, 72 and the side panels 74, 76, the upper side of bottom panel 80, and the underside of bottom member 25, as well as both sides of transverse panel 78, are lined with a known insulating, sound absorbing material. Such insulating material is usually one to two inches thick and forms the interior surface of the return air noise reduction duct 62 and supply air noise reduction duct 64.

The curb 60 is usually constructed at a manufacturing plant and shipped complete to the building site for installation on the building during construction thereof. In cases of very wide air conditioning units 10, such as a 100 Ton unit, the curb 60 may be formed in two or more sections and shipped to the building site in a disassembled condition for final assembly. It is desirable, where possible, to ship the curb 60 in a fully assembled condition. This helps to ensure that the curb 60 is watertight when installed and minimizes the expense associated with need for skilled labor at the building site.

In operation, return air flow rises in return air duct 50 and enters returns air noise reduction duct 62 at the point where return air duct 50 is joined with return air noise reduction duct 62. This point of intersection is physically located beneath outside air plenum 62.

After entering return air noise reduction duct 62, the return air makes a right hand turn as best depicted in FIG. 5, and flows transverse to the longitudinal axis of air conditioning unit 10. At the end of the transverse section of flow, the return air makes a second right hand turn and enters return air plenum 22 through return air inlet 24. Once in return air plenum 22, the return air is either exhausted by exhaust fans 26 or the return air passes through loopers 28 to be reconditioned as supply air.

The major source of noise in the return air duct 50 of the building serviced by air conditioning unit and is caused by exhaust fans 26. In a typical application, exhaust fans 26 are energized based on a selected differential pressure that is sensed between the interior of the building and the atmosphere outside. This differential pressure is caused by the forced flow of supply air. The differential pressure may be relieved by a number of sources apart from air conditioning unit 10. Such sources include frequent opening of doors to the exterior, exhaust falls that may be utilized in certain portions of the building and the utilization of laboratories. If such sources or pressure relief keep the pressure differential within an acceptable band, the exhaust fans are not energized. Accordingly, it has been seen that the exhaust fans 26 as used in many typical installations are relatively infrequently energized. Accordingly, the noise problem in the return air ducts 50 is not seen as being as great as the noise problem in the supply air ducts 54. Consequently, a shorter straight flow section in return air noise reduction duct 62 is adequate as compared to what will be shown as a longer straight flow section utilized in conjunction with supply air noise reduction duct 64.

Cooled or heated supply air is exhausted from supply air fans 30 in a turbulent, high velocity, high pressure condition. A supply air makes a right hand turn as indicated by arrow 84 and passes through supply air outlet 34 of supply air plenum 32. This supply air enters supply air noise reduction duct 64 and makes a second right hand turn. This turn is followed by a relatively long straight section of flow in the longitudinal direction of air conditioning unit 10. At the end of the straight section of flow, the supply air makes a third right hand turn and exists supply air noise reduction duct 64 at the intersection of supply air duct 54 with supply air noise reduction duct 64.

There are two objectives to be accomplished in supply air noise reduction duct, 64. The first is that the turbulence of the supply air be diminished by flowing in a relatively long straight flow section. The second is that there be no pressure increase caused by supply air noise reduction duct 64, Accordingly, the cross-sectional area of supply air noise reduction duct 64 is maintained constant throughout its length. Further, the heighth of supply air noise reduction duct 64 is generally equal to the shorter of the two dimensions of supply air outlet 34. In a 40 Ton air conditioning unit 10, for example, the short dimension of supply air outlet 34 is generally between 30 and 36 inches. Accordingly, it has been shown that heighth of supply air noise reduction duct 64 that is between 30 and 36 inches meets the aforementioned two objectives, although heighths between 24 and 40 inches will also perform the desired noise reduction.

To provide increased cooling capacity for the building, such as in a 120 Ton air conditioning unit 10, it is general practice in the industry to increase the width dimension of the air conditioning unit 10. Increasing this dimension, results in increasing the longer of the two dimensions of supply air outlet 34, while leaving the shorter of the two dimensions in the range of 30 to 36 inches. Accordingly, a heighth of noise reduction curb 60 that is in the range of 30 to 36 inches has been shown to be adequate to service air conditioning units in the range of 40 to 120 Tons. This has the added advantage of minimizing the projection of the air conditioning unit 10 above the plane of the roof. For aesthetic and other reasons, maintaining as low a profile as possible is desirable. As indicated by comparison of the present invention as depicted in FIGS. 3–5 with the prior art as depicted in FIGS. 1 and 2, the curb 60 is somewhat taller then the prior art devices. By limiting the height to no more than 36 inches for the wide variety of air conditioning units 10 that are served, the increase in profile that results from incorporation of the curb 60 is minimized.

FIG. 6 is a graph of the sound pressure level actually measured in a typical room below the supply duct over eight octaves of the NC curves. As previously indicated, when rating a particular configuration, the highest reading over the entire octave spectrum is selected. Accordingly, it can be seen that the prior art curb yielded an NC of 48. This reading occurred an approximately 250 Hertz. The noise reduction curb 60 of the present invention yielded a highest reading of NC of 37. This reading occurred at approximately 125 Hertz.

FIG. 7 is a similar type graph that plots the actual sound pressure level measured in a typical room below the return duct across the eight octaves of the NC curves. Again picking peak measurement for each of the runs, it can be seen that the prior art curb had an NC value of 45. This measurement occurred at whereas the noise reduction curb 60 of the present invention had an NC level of 38. Looking at the two curbs presented in FIGS. 6 and 7, the highest prior art curb reading was an NC of 48 and the highest NC reading for the noise reduction curb was 38. Accordingly, the noise reduction curb 60 of the present invention resulted in a ten NC reduction over the prior art curb under similar conditions.

Although a certain embodiment of the present invention has been shown and described, it is obvious that many modifications and variations thereof are possible in light of the teachings. It is to be understood therefore that within the scope of the appended claims, the invention may be practiced otherwise than as specifically described herein.

What is claimed is:

1. A curb for supporting an air conditioning unit comprising:

four exterior walls joined in a box like shape and arranged to support an air conditioning unit;

a bottom for the box including a return air aperture and a supply air aperture; and a dividing wall in the box separating the supply and return air apertures and forming a return air duct and a supply air duct;

wherein the supply air duct is arranged to provide a flow of supply air to the supply air aperture, the return air duct is arranged to provide airflow of return air from the return air aperture, and the supply air duct is arranged so that the supply air flow is in a first direction perpendicularly to the direction of the return airflow in the return air duct.

2. The curb of claim 1 wherein the curb has a longitudinal dimension and a lateral dimension and where the supply air duct is substantially aligned with the longitudinal dimension and the return air duct is aligned with the lateral dimension.

3. The curb of claim 2 wherein the supply air duct and the return air duct form a T shape.

4. The curb of claim 3 wherein the return air duct forms a horizontal part of the T-shape and the supply air duct forms a vertical part of the T-shape.

5. A noise reduction curb for use as an interface with a rooftop air conditioning unit by forming a base upon which the air conditioning unit rests and being mounted on a roof of a building, the air conditioning unit being generally rectangular in platform, having a longitudinal dimension and a lateral dimension, the lateral dimension being less than the longitudinal dimension, and receiving a quantity of return air from return air ducts in the building and supplying a quantity of conditioned supply air to supply air ducts in the building comprising:

a noise reduction supply air duct oriented in the longitudinal dimension of the air conditioning unit and having a supply air inlet fluidly coupled to the supply air source in the air conditioning unit adapted to receive the quantity of conditioned supply air to supply air therefrom and a supply air outlet fluidly coupled directly to the supply ducts in the building adapted to supply the quantity of conditioned supply air to supply air thereto, the supply air inlet being longitudinally displaced from the supply air outlet and being separated therefrom by a flow turbulence reducing substantially straight duct section, and;

a noise reduction return air duct oriented in the lateral dimension of the air conditioning unit and having a return air inlet fluidly coupled directly to the return air ducts in the building adapted to receive the quantity of return air therefrom and a return air outlet fluidly coupled to the air conditioning unit adapted to return the quantity of return air thereto, the return air inlet being laterally displaced from the return air outlet.

6. A noise reduction curb as claimed in claim 5 wherein the position of the return air inlet of the noise reduction return air duct relative to the return air outlet of the noise reduction return air duct substantially eliminates line of sight sound transmission from the air conditioning unit to the return air ducts in the building.

7. A noise reduction curb as claimed in claim 5 wherein the position of the supply air inlet of the noise reduction supply air duct relative to the supply air outlet of the noise reduction supply air duct substantially eliminates line of sight sound transmission from the air conditioning unit to the supply air ducts in the building.

8. A noise reduction curb as claimed in claim 7 wherein the supply air inlet has a generally rectangular shape having selected length and width dimensions, the length dimension being oriented along the lateral dimension of the air conditioning unit and the noise reduction supply air duct has selected height and width dimensions, the width dimension extending generally the full lateral dimension of the air conditioning unit and the height dimension being substantially equal to the width dimension of the supply air inlet.

9. A noise reduction curb as claimed in claim 8 wherein the cross sectional shape and area of the noise reduction supply air duct are generally the same as the cross sectional shape and area of the supply air inlet, and the cross sectional shape and area of the noise reduction return air duct are generally the same as the cross sectional shape and area of the return air outlet.

10. A noise reduction curb as claimed in claim 9 wherein the flow turbulence reducing substantially straight duct section of the noise reduction supply air duct extends for a length that is greater than four times the width dimension of the supply air inlet.

11. A noise reduction curb as claimed in claim 10 further including:

spaced apart longitudinal side walls and spaced apart lateral end walls defining a rectangular shape;

a top wall joined to the longitudinal side walls and to the lateral end walls and having structure defining the supply air inlet and the return air outlet therein;

a bottom wall spaced apart from the top wall and joined to the longitudinal side walls and to the lateral end walls and having structure defining the supply air outlet and the return air outlet therein;

a lateral separating wall disposed between the lateral end walls and extending between the longitudinal side walls and between the top wall and the bottom wall, fluidly separating the noise reduction supply air duct from the noise reduction return air duct.

12. A noise reduction curb for use with an air conditioning unit, the air conditioning unit supplying conditioned air to a building via a building supply duct installed in the building and receiving return air via a building return duct installed in the building, comprising:

structure defining a noise reduction supply air duct fluidly coupling the air conditioning unit to the building supply duct, the noise reduction supply air duct having an elongated section, a supply air inlet defined at a first end of the elongated section and a supply air outlet defined at a second end of the elongated section, the noise reduction supply air duct defining a path of travel having a generally right angle turn from the supply air inlet to the elongated section, straight flow through the elongated section and a generally right angle turn from the elongated section to the supply air outlet; and structure defining a noise reduction return air duct fluidly coupling the building return duct to the air conditioning unit and having an intermediate portion, a return air inlet defined at a first end of the intermediate portion and a returning air outlet defined at a second end of the intermediate portion, the return air inlet being offset with respect to the return air outlet and the noise reduction return air duct defining a flow path of travel having a generally right angle turn at the return air inlet to the intermediate portion and a generally right angle turn at the return air outlet from the intermediate portion.

13. A noise reduction curb as claimed in claim 12 wherein the position of the return air inlet of the noise reduction return air duct relative to the return air outlet of the noise reduction return air duct substantially eliminates line of sight sound transmission from the air conditioning unit to the building return ducts in the building.

14. A noise reduction curb as claimed in claim 13 wherein the position of the supply air inlet of the noise reduction supply air duct relative to the supply air outlet of the noise reduction supply air duct substantially eliminates line of sight sound transmission from the air conditioning unit to the building supply ducts in the building.

15. A noise reduction curb as claimed in claim 14 wherein the cross sectional shape and area of the noise reduction return air duct are generally the same as the cross sectional shape and area of the return air outlet.

16. A noise reduction curb as claimed in claim 15 wherein the cross sectional shape and area of the noise reduction supply air duct are generally the same as the cross sectional shape and area of the supply air inlet.

17. A noise reduction curb as claimed in claim 16 wherein the supply air inlet has a generally rectangular shape having selected length and-width dimensions, the length dimension being oriented along the lateral dimension of the air conditioning unit and the noise reduction supply air duct has selected height and width dimensions, the width dimension extending generally the full lateral dimension of the air conditioning unit and the height dimension being substantially equal to the width dimension of the supply air inlet.

18. A noise reduction curb as claimed in claim 17 wherein the elongated section of the noise reduction supply air duct extends for a length that is greater than four times the width dimension of the supply air inlet.

19. A noise reduction curb as claimed in claim 18 further including:

spaced apart longitudinal side walls and spaced apart lateral end walls defining a rectangular shape;

a top wall joined to the longitudinal side walls and to the lateral end walls and having structure defining the supply air inlet and the return air outlet therein;

a bottom wall spaced apart from the top wall and joined to the longitudinal side walls and to the lateral end walls and having structure defining the supply air outlet and the return air outlet therein;

a lateral separating wall disposed between the lateral end walls and extending between the longitudinal side walls and between the top wall and the bottom wall, fluidly separating the noise reduction supply air duct from the noise reduction return air duct.

20. A sound attenuation curb for use with an air conditioning unit mounted on a building rooftop, the air conditioning unit having a return air inlet for receiving a flow of return air from a return air duct disposed within the building and having a supply air outlet for providing a flow of conditioned supply air to a supply duct disposed within the building, comprising:

supply air sound attenuator having an elongated flow duct interposed between the air conditioning unit supply air side and the building supply duct, the elongated flow duct being operably fluidly coupled proximate a first end to the air conditioning unit supply air outlet and being operably fluidly coupled proximate a second end to the building supply duct and having a substantially uniform cross section, the cross sectional area being substantially equal to the area of the supply air outlet; and return air sound attenuator having a flow duct, the flow duct having an inlet and an outlet, the outlet being operably fluidly coupled to the air conditioning unit, return air inlet and the inlet being operably fluidly coupled to the building return air duct, the flow duct inlet and the flow duct outlet being spaced apart and oriented such that the return air sound attenuation means flow duct and the supply air sound attenuation means flow duct define a T shape.

* * * * *

UNITED STATES PATENT AND TRADEMARK OFFICE

CERTIFICATE OF CORRECTION

PATENT NO. : 5,522,768

DATED : June 4, 1996

INVENTOR(S) : Clarence R. Brodt, Gregory L. Meeuwsen and Richard T. Weisbecker

It is certified that error appears in the above-identified patent and that said Letters Patent is hereby corrected as shown below:

Column 5, Line 22, "ms" should read --is--.

Column 7, Line 7, "falls" should read --fans--.

Signed and Sealed this

Twenty-seventh Day of August, 1996

*Attest:*

*Attesting Officer*

BRUCE LEHMAN

*Commissioner of Patents and Trademarks*